United States Patent [19]

Hunt

[11] 4,422,439

[45] Dec. 27, 1983

[54] FIREPLACE ADAPTERS

[75] Inventor: Richard L. Hunt, Warren, Ohio

[73] Assignee: David C. Frazier, Southington, Ohio

[21] Appl. No.: 204,471

[22] Filed: Nov. 6, 1980

[51] Int. Cl.[3] ..... F24B 7/00

[52] U.S. Cl. ..... 126/123; 126/318; 126/126

[58] Field of Search ..... 126/318, 314, 123, 126, 126/127, 307 R; 285/191, 175; 248/354 C, 354 P

[56] References Cited

U.S. PATENT DOCUMENTS

| | | | |
|---|---|---|---|
| 1,511,562 | 10/1924 | Huebner | 126/318 |
| 1,835,703 | 12/1931 | Flaherty | 126/314 |
| 2,085,646 | 6/1937 | Frankland | 126/314 |
| 4,026,264 | 3/1977 | Henriques | 126/123 |

*Primary Examiner*—Samuel Scott
*Assistant Examiner*—G. Anderson
*Attorney, Agent, or Firm*—Michael Williams

[57] ABSTRACT

An adapter for use with a fireplace, wherein the stove pipe of a stove standing in a room to be heated may be connected to the flue of the chimney so that products of combustion from the stove may be safely exhausted through the flue and outwardly of the chimney. The adapter may be easily installed within the fireplace by removing the damper plate and fitting the adapter to the damper frame. Each of a pair of bolts has a portion which hooks over a portion of the damper frame and a threaded end depending from the hook portion and extending through a hole in the adapter. Nuts are threaded on the bolts and are adapted to force the adapter into a tight fit with the adapter frame.

8 Claims, 6 Drawing Figures

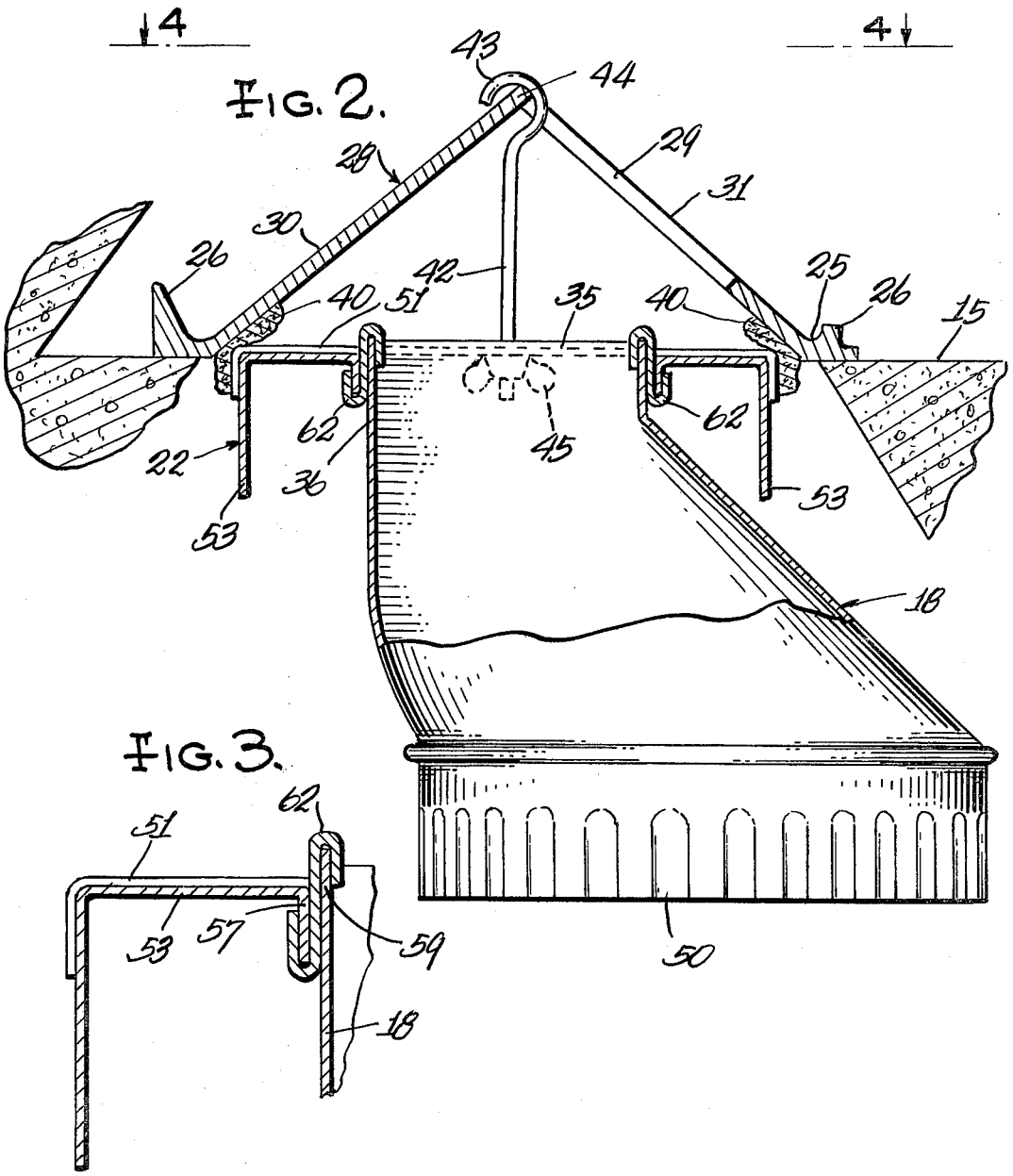
FIG. 2.
FIG. 3.
FIG. 4.
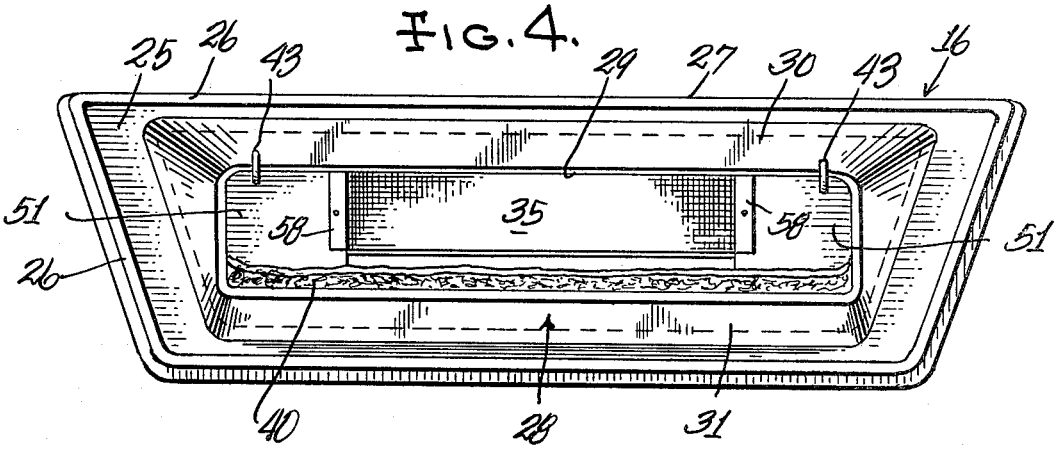

43
10
A
41
54
58
62
60
54
35
53
42
B
52
45
54
60
62
53
36
41
58
54
22
52
B
18

51
41
55
52
52
61

56
55
61
55
53
41
53
56
52
51
52
57
58
61
62
35
59
36
62
59
58
61
18

FIREPLACE ADAPTERS

BACKGROUND AND SUMMARY

Fireplaces are quite commonplace in houses and other inhabitable places, but the heat issuing therefrom a negligible. Not only does the heat from a fireplace tend to unbalance a central heating system, but the fireplace is actually wasteful since it tends to draw air from a room to heat the same, and this heated air goes up the chimney instead of back into the room.

In order to reduce this waste of heat, fireplace enclosures were provided with glass doors, but such doors, or the enclosure, had to have some openings to pass air from the room for combustion purposes. Although glass doors helped to some extent, the amount of heat returned to the room was limited largely to that radiated from the glass doors.

The old-fashioned pot-bellied stoves standing entirely within a room were good from a heating standpoint, but these stoves required a chimney connection. Since a fireplace has a chimney connection, various attempts were made to utilize such connection for a stove but, to my knowledge, such attempts were not commercially successful because of the expense involved or because a satisfactory connection could not be easily made.

My improved adapter makes it possible to easily connect a stove pipe of a stove for safe and effective communication with the chimney flue of a fireplace. With heating fuel in short supply and with no material relief in sight in the immediate future, my improved adapter has had great public acceptance, since it quickly and economically converts a fireplace for use with a wood, coal or oil burning stove. All that is necessary is to remove the damper in the fireplace and securely hook my adapter to the damper frame.

DESCRIPTION OF THE DRAWINGS

In the drawings accompanying this specification and forming a part of this application there is shown, for purpose of illustration, an embodiment which my invention may assume, and in these drawings:

FIG. 2 is an enlarged fragmentary sectional view showing the connection of the adapter with the frame of a fireplace damper, FIG. 3 is an enlarged, fragmentary sectional view of a connection of certain parts shown in FIG. 2, FIG. 4 is a top plan view corresponding generally to the line 4—4 of FIG. 2.

DESCRIPTION OF THE PREFERRED EMBODIMENT

Figure 1:
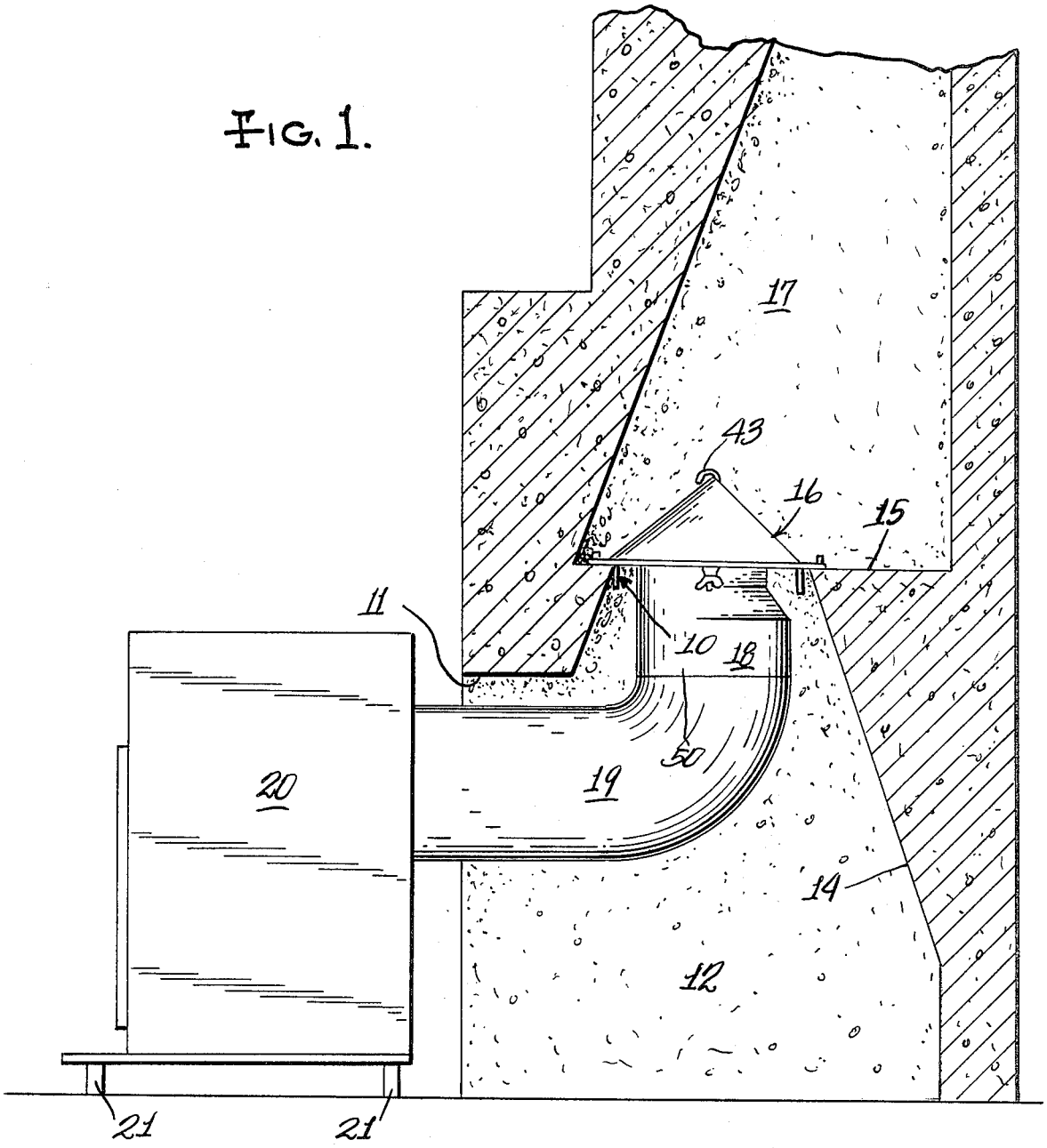
FIG. 1 is a generally schematic representation showing use of my improved adapter in connection with a stove and a fireplace.

As seen in FIG. 1 my improved adapter 10 is constructed and arranged to fit within a typical masonary fireplace having a front opening 11 leading inwardly to a firebox 12 which is adapted to contain a conventional gate (not shown) when the fireplace is used to burn wood in the normal manner. The rear wall 14 is inclined forwardly to a shelf 15 on which the frame 16 of a conventional damper is mortared in place. The damper frame communicates with a flue 17 leading to a chimney (not shown).

The adapter 10 is connected to the damper frame and supports a downwardly-extending boot 18 which has connection to the stove pipe 19 of a stove 20 of any suitable construction. As shown, the stove 20 is outside the fireplace and supported on legs 21 from the floor of the room to be heated. The stove may burn wood, coal, coke, oil or any other like substance, and since it is located outside of the fireplace, it will radiate heat directly into the room. The adapter 10 closes the opening of the damper frame, except for the boot 18, so that only products of combustion escape into the chimney flue 17.

Figure 5:
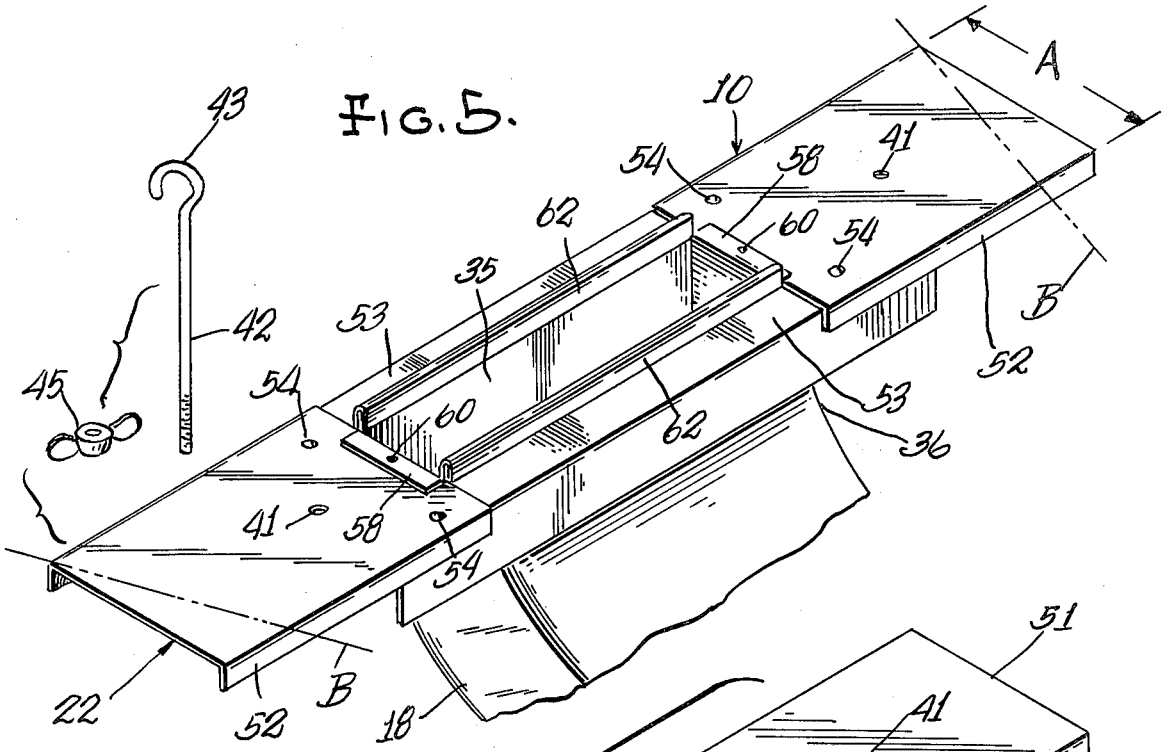
FIG. 5 is a fragmentary perspective view of my improved adapter, showing a hook bolt in separated relation.

As seen in FIGS. 2 and 5, the adapter 10 comprises a flat, plate-like body 22 which is adapted to fit the damper frame in a sealed manner, the adapter body being about the size and outline of the opening into the damper frame 16. Fireplaces have damper frames of various sizes, so to accomodate this, I propose to manufacture my adapter in various standard sizes, each one to fit a particular damper frame.

Most damper frames are of uniform construction and are illustrated in FIGS. 2 and 4 as a metal casting providing a flat body portion 25 with upstanding reenforcing ribs 26 along the margins thereof. Usually, the body portion 25 is trapezoidal in plan, with the long opposite sides parallel and the shorter ends inclined toward each other. The damper frame is mortared in place, usually with the longer margin 27 toward the front of the fireplace. Extending upwardly from the body portion 25 is an integral hood 28 having a rectangular opening 29 therein. As suggested, both pairs of opposite walls in FIG. 4 defining the hood 28 incline inwardly, as specifically shown at 30 and 31 in FIG. 2, for the long opposite walls defining the hood.

The flat body portion 22 of the adapter 10 has a transverse dimension A (FIG. 5) which normally fits within the transverse, inwardly-tapering opening of the damper frame (as seen in FIG. 2). Sometimes the damper frames vary in length and shape in the longitudinal direction and therefore the opposite ends of the flat body 22 portion of the adapter 10 may be required to be trimmed, as suggested by the dotted lines B in FIG. 5, to promptly fit lengthwise into the opposite tapering sides of the damper frame.

The flat body portion 22 of the adapter 10 has a centrally-located, preferably-rectangular opening 35 there in, and the neck 36 of the boot 18 fits within such opening in leakproof manner. It will be noted that the boot 18 is wider than the adapter 10 on one side (the rearside in FIGS. 1 and 2) and before assembling the adapter 10 with the damper frame, it should be determined whether this wider side should be positioned toward the front or rear of the damper frame to provide adequate clearance for the boot. It will be appreciated that the boot may be disposed in the preferred position by horizontally rotating the adapter body portion end-for-end before assembly with the damper frame.

In order to insure that products of combustion do not leak back into the room, insulation is applied between the adapter and adjoining surfaces of the damper frame. Preferably, strips of fiber glass insulation are cemented along the top surface of the marginal portions of the adapter so that when the latter is drawn against the adapter, the insulation (shown at 40 in FIG. 2) will be pinched between the edge surface of the adapter and the adjoining inclined surface of the damper frame.

Figure 6:
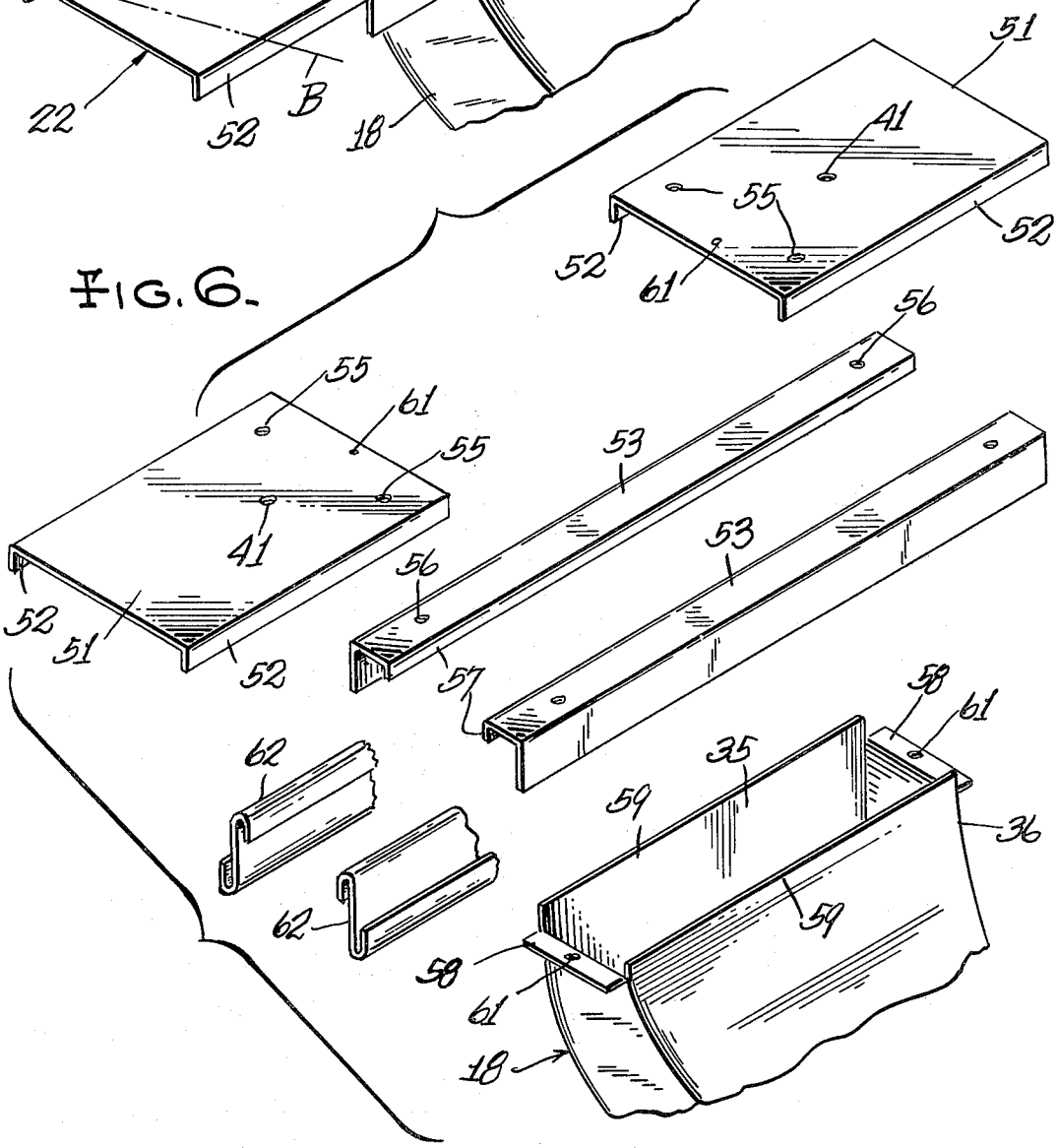
FIG. 6 is a perspective view of parts which form the adapter.

My invention includes new and efficient means for holding the adapter assembled with the damper frame. As seen in FIGS. 5 and 6 of the drawings, the plate-like body portion of the adapter has holes 41—41 on opposite sides of the rectangular opening 35, each to pass the threaded shank 42 of a bolt having a hook 43 at its upper portion. Each hook is adapted to engage over a marginal portion 44 (see FIG. 2) of the hood 28. As the nuts 45 are threaded onto the shanks 42, the adapter body portion 22 is drawn upwardly so that its top edges wedge into the throat wall surfaces of the hood so as to tightly pinch the insulation therebetween. The nuts 45 are preferably wing nuts so as to eliminate the need for any special tools for assembling the adapter 10 with the damper frame 16.

Assembly of the adapter with the frame is a simple matter and may be performed by one with little mechanical skill. After the length of the adapter has been cut to size (FIG. 5) in order to fit lengthwise within the throat of the damper plate, and after the insulation strips have been cemented to the upper marginal surface of the adapter, the latter is moved to position within the throat of the damper frame, and this will largely position the adapter horizontally with the frame.

It is preferred to first remove the damper plate from the frame to prevent any accidental closure of the damper during subsequent use of the fireplace, but also to make it easier to assemble the adapter with the frame. Normally, the damper plate has oppositely-extending pivot stubs which merely rest within pivot posts so that the plate may be removed merely by lifting the stubs from the posts. Sometimes it is first necessary to remove the damper operating handle, but this is no great problem since it is usually held in place by screws or cotter pins. In some cases the damper plate pivot posts are in the form of brackets which prevent the adapter plate from being positioned within the throat of the damper plate, and it may be necessary to cut out slots in the adapter body plate to pass such brackets. The slots may have to be sealed with fire place cement.

Once the adapter body portion 22 is disposed within the throat of the damper frame, and with the bolts 42 hanging loose, the installer will be required to move each bolt upwardly and reach through the boot 18 to grasp the hook with the fingers and hook it over the marginal surface 44 of the hood 28 to the position shown in FIG. 2. The wing nuts 45 are then tightened on each bolt until the adapter is firmly wedged into the throat of the damper plate, with the insulation pinched therebetween.

The boot 18 has a rectangular upper end to fit the corresponding opening in the adapter body 22 and this upper end merges with a cylindrical lower end 50. Stove pipe sections may then be selected to fit the exhaust outlet stub from the stove 20 and to fit between the stub and the cylindrical end 50 of the boot in customary manner. If desired, sheet metal screws (not shown) may be driven into each pipe joint to prevent separation of pipe and boot parts.

The adapter may be formed in any suitable manner, but presently it is preferred to form the adapter in the manner shown in FIG. 6. Thus, a pair of sheet metal end sections 51—51 are formed with down-turned stiffening margins 52. Each end section may contain the hole 41 for passing the shank 42 of a fastening bolt.

A pair of elongated sheet metal angle members 53—53 are connected to respective end sections 51 by rivets 54 passing through holes 55 in the end sections which are aligned with holes 56 in the angle members, and the rivets are headed over to firmly hold the end sections and angle members assembled and to form the rectangular opening 35 therebetween. Each of the angle members 53 has an inwardly-disposed, downwardly-turned margin 57.

The boot 18 has ears 58 bent outwardly at opposite smaller ends of its rectangular opening, to leave upstanding side portions 59 therebetween. The upper end of the boot is worked through the rectangular opening formed by the connected parts 51 and 53 so that the ears 58 overile the adjoining marginal portions of the end sections 51, and rivets 60 are passed through aligned holes 61 and headed over. In some cases, it may be desirable to first assemble the boot 18 with end sections 51—51 before adding the angle members 53—53. Further, instead of riveting, the parts may be joined by spot welds.

Since the ears 58—58 of the boot lie flush with the adjoining upper surfaces of the end sections 51—51, the side portions 59—59 extend upwardly of such upper surfaces, and these side portions are interlocked with the downwardly-turned margins 57 of the angle members by sheet metal joiner sections 62 to form a sheet-metal lock joint as best seen in FIG. 3.

I claim:

1. An adapter for use in connecting the combustion outlet of a stove to the chimney flue of a fireplace, said flue including a metal damper frame having a lower peripheral portion defining a mouth opening into said fireplace and an upper peripheral portion defining an opening to a chimney flue, said lower portion being connected to walls defining said fireplace to span said flue for passage of products of combustion therethrough, said adapter comprising:

a metal body having a planar portion underlying said damper frame lower portion and having an upper surface adapted to engage an undersurface of said damper frame at the periphery thereof surrounding said mouth, said planar portion of said adapter having an opening in line and communicating with said mouth, a tubular metal boot adapted to have one end connected to said stove combustion outlet to receive products of combustion therefrom, said boot having its other end adapted for connection to the planar portion of said adapter in a manner to limit passage of products of combustion from said stove through said boot and adapter opening and through said damper frame mouth to and through said chimney flue, and tension means connected between said adapter body and said damper frame upper portion, said tension means extending through said chimney flue opening thereof for engagement there at and through said damper frame lower mouth opening, and operable to draw said adapter body upwardly to press the upper surface of said adapter planar portion against the undersurface of said damper frame portion to restrict escape of combustion products through the engaging surfaces of said adapter and said damper frame, said tension means being free of any components extending downwardly any substantial distance from said adapter body, thereby to provide unobstructed access to said boot and to a said stove associated with the fireplace.

2. The construction according to claim 1 wherein said damper frame lower portion is rectangular in plan and defined by a pair of long opposing walls and a pair of narrow opposing walls, said pairs of opposing walls extending upwardly and tapering inwardly to form a rectangular throat defined by inwardly-tapering surfaces, one of said long opposing walls having said chimney flue opening formed therein, said adapter body having a peripheral portion of rectangular shape and sized to fit within said rectangular throat.

3. The construction according to claim 1 wherein said adapter body opening is rectangular in shape, and said boot having an upper rectangular component fitting the defining surfaces of said body opening in sealed manner, said boot having a lower circular component merging with said rectangular component and adapted to fit with a pipe leading from said stove combustion outlet.

4. The construction according to claim 3 wherein said adapter body comprises a pair of sheet metal longitudinally-spaced-apart end pieces, a pair of sheet metal angle pieces spaced laterally and each connected to an end piece to combine therewith to form said rectangular opening, the rectangular component of said boot extending through said rectangular opening and having an ear at each short margin overlying and secured to an adjacent portion of a respective end piece, each of the long margins of said rectangular component having a lock seam connection with an adjoining portion of a respective angle piece.

5. The construction according to claim 1 wherein said tension means comprises a bolt having a hook at one end for engagement over a part of said damper frame, and having a threaded shank extending through an opening in said adapter body, and a nut threaded on said shank to draw said adapter body upwardly.

6. The construction according to claim 1 wherein insulating means is interposed between the upper surface of said adapter portion and the undersurface of said lower damper frame portion to seal against escape of products of combustion.

7. The construction according to claim 1 wherein said damper frame mouth opening leads into an upwardly-extending inwardly-tapering throat, the marginal surfaces of said adapter body planar portion fitting within said throat, the tension of said tension means wedging such marginal surfaces against surfaces defining said throat.

8. The adapter of claim 1 wherein said metal body planar portion is fabricated from a plurality of connected pieces defining said opening therein, thereby to accommodate damper frame mouth openings of varying dimensions.

* * * * *